US011014705B2

(12) United States Patent
Strange

(10) Patent No.: US 11,014,705 B2
(45) Date of Patent: May 25, 2021

(54) COLLAPSIBLE CONTAINER AND A METHOD OF MAKING A COLLAPSIBLE CONTAINER

(71) Applicant: The Benjamin Group Limited, Droitwich (GB)

(72) Inventor: Benjamin Alex Strange, Droitwich (GB)

(73) Assignee: The Benjamin Group Limited, Droitwich (GB)

( * ) Notice: Subject to any disclaimer, the term of this patent is extended or adjusted under 35 U.S.C. 154(b) by 226 days.

(21) Appl. No.: 15/759,720

(22) PCT Filed: Sep. 16, 2016

(86) PCT No.: PCT/GB2016/052903
§ 371 (c)(1),
(2) Date: Mar. 13, 2018

(87) PCT Pub. No.: WO2017/046609
PCT Pub. Date: Mar. 23, 2017

(65) Prior Publication Data

US 2018/0339801 A1 Nov. 29, 2018

(30) Foreign Application Priority Data

Sep. 18, 2015 (GB) ..... 1516615

(51) Int. Cl.
*B65D 6/18* (2006.01)
*B65D 1/22* (2006.01)
*B65D 43/02* (2006.01)

(52) U.S. Cl.
CPC ..... *B65D 11/186* (2013.01); *B65D 1/225* (2013.01); *B65D 11/1833* (2013.01); *B65D 43/0222* (2013.01)

(58) Field of Classification Search
CPC .. B65D 11/186; B65D 1/225; B65D 43/0222; B65D 11/1833; B65D 11/18; B29C 45/14
(Continued)

(56) References Cited

U.S. PATENT DOCUMENTS 3,156,371 A 11/1964 Harrison
3,376,994 A * 4/1968 Flinn, Jr. ..... B65D 9/32 220/6

(Continued)

FOREIGN PATENT DOCUMENTS

DE 202007004432 U1 6/2007
EP 0516954 A1 12/1992

(Continued)

OTHER PUBLICATIONS

Combined Search and Examination Report under Section 17 and 18(3) for GB1516615.0 dated Mar. 17, 2016.

(Continued)

*Primary Examiner* — Ernesto A Grano
(74) *Attorney, Agent, or Firm* — Bishop, Diehl & Lee, Ltd.

(57) ABSTRACT

A collapsible container (100) has an unfolded configuration for use of the container and a folded configuration for storage of the container. The container 100 comprises a plurality of panels arranged to form a base (104*a*); a first side wall (104*h*) pivotally connected to a first edge of the base (104*a*) by a first flexible hinge member (108); a second side wall (104*b*) pivotally connected to a second edge of the base (104*a*) by a second flexible hinge member (108), the second edge of the base being adjacent to the first edge of the base. In the folded configuration, the first side wall (104*h*) lies between the base (104*a*) and the second side wall (104*b*) and the second flexible hinge member (108) is longer than the first flexible hinge member (108) so as to accommodate the (Continued)

Figure 1:
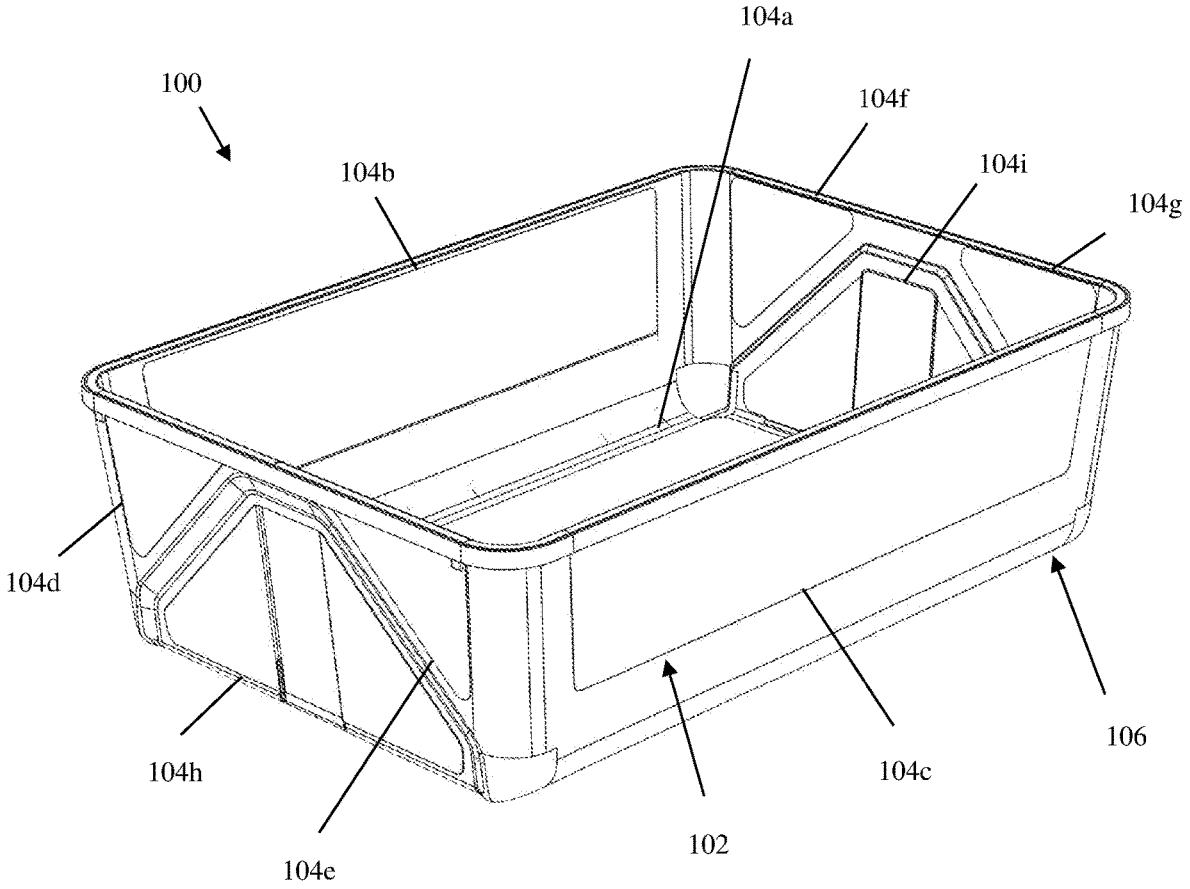

first side wall (104*h*) between the base (104*a*) and the second side wall (104*b*).

22 Claims, 9 Drawing Sheets

(58) Field of Classification Search
USPC ..... 220/796, 6, 666, 780
See application file for complete search history.

(56) References Cited

U.S. PATENT DOCUMENTS

| | | | | |
|---|---|---|---|---|
| 3,445,052 | A * | 5/1969 | Lewallen | E05D 1/02 428/158 |
| 4,896,787 | A * | 1/1990 | Delamour | B65D 1/225 220/6 |
| 5,472,107 | A * | 12/1995 | Lieber | B65D 1/225 220/6 |
| 5,735,423 | A * | 4/1998 | Black | B65D 1/225 220/23.83 |
| 5,741,570 | A * | 4/1998 | Seufert | B65D 5/4266 220/62 |
| 5,918,798 | A | 7/1999 | Frahm | |
| 6,401,995 | B1 * | 6/2002 | Yuille | B60R 7/02 220/483 |
| 6,918,503 | B1 * | 7/2005 | Molander | B29C 65/5042 220/6 |
| 8,308,630 | B2 * | 11/2012 | Birk | A61B 5/0031 600/37 |
| 8,509,865 | B1 * | 8/2013 | LaColla | H04M 1/04 455/556.1 |
| 9,797,439 | B2 * | 10/2017 | Masini | E05D 1/00 |
| 2004/0164132 | A1 * | 8/2004 | Kuester | B65D 1/225 229/117.06 |
| 2007/0056970 | A1 * | 3/2007 | Scherer | B65D 25/14 220/62.22 |
| 2007/0102384 | A1 | 5/2007 | Albenda | |
| 2008/0203092 | A1 * | 8/2008 | Stamper | B65D 43/0218 220/203.01 |
| 2008/0272117 | A1 * | 11/2008 | Roos | A45C 7/0077 220/6 |
| 2008/0302789 | A1 * | 12/2008 | Stevenson | B65D 7/26 220/4.33 |
| 2009/0090709 | A1 * | 4/2009 | Shalomoff | B65D 11/1833 220/6 |
| 2011/0056934 | A1 * | 3/2011 | Fuisz | B65D 75/06 220/6 |
| 2011/0284532 | A1 * | 11/2011 | Naik | B65D 75/327 220/6 |
| 2012/0024941 | A1 * | 2/2012 | Skinner | B29C 66/542 229/198.2 |
| 2012/0187118 | A1 | 7/2012 | Glenn | |
| 2013/0040076 | A1 | 2/2013 | Jones et al. | |
| 2013/0161330 | A1 * | 6/2013 | Gualersi | B65D 11/1833 220/529 |
| 2015/0239627 | A1 * | 8/2015 | Ivankovic | B65D 53/02 53/488 |
| 2019/0256246 | A1 * | 8/2019 | Gilstrap | B65D 11/1833 |

FOREIGN PATENT DOCUMENTS

| | | | |
|---|---|---|---|
| EP | 2840033 | A1 | 2/2015 |
| FR | 2172047 | A1 | 9/1973 |
| FR | 2682664 | A1 | 4/1993 |
| FR | 2997638 | A1 | 5/2014 |
| GB | 1298704 | A | 12/1972 |
| GB | 2448008 | A | 10/2008 |
| WO | 02/085594 | A2 | 10/2002 |

OTHER PUBLICATIONS

International Search Report for PCT/GB2016/052903 dated Jan. 11, 2017.
Examination Report under Section 18(3) for GB1516615.0 dated Nov. 10, 2017.
Examination Report for GB1516615.0 dated May 8, 2018.
Examination Report for 16770333.9 dated Apr. 24, 2020.

* cited by examiner

COLLAPSIBLE CONTAINER AND A METHOD OF MAKING A COLLAPSIBLE CONTAINER

The present invention relates to a collapsible container and a method of making a collapsible container.

It is known to provide containers that may be collapsible so as to save space when the container is empty and being stored. The walls of such a container may be provided with fold lines (e.g. 'living hinges') so that the container can move from an unfolded configuration when the container is in use, to a folded configuration suitable for storing the container. When such a container is moved to the folded position, stress points may be created within the folds or hinges at points where the panels or walls of the container meet (e.g. in the corners of the container). These stress points may lead to failure of the material which may lead to cracking of the container. The stress points may also prevent the container from folding to a fully folded configuration and so the container cannot be efficiently stored.

Although the invention is discussed with respect to relatively small containers, for example to be used as lunch boxes, storage crates, or the like, the skilled person will appreciate that the same design features could be used for larger, stowable containers which may serve the purpose of providing an enclosure, for example as a pen, playhouse or emergency shelter.

In a first aspect, the present invention provides a collapsible container, comprising: a framework comprising a plurality of pivotally connected panels; and one or more flexible seals interposed between the plurality of panels to form a seal therebetween, wherein the plurality of panels are movable between an unfolded configuration for use of the container and a folded configuration for storage of the container.

The container of the present invention comprises a framework of pivotally interconnected panels along with one or more seals to seal the container. By forming the container from a framework of panels combined with flexible seals, the material properties can be varied according to their position within the container. This may allow flexing and deformation of the container material in some areas (e.g. in the corners of the container), but may allow rigidity of the container in other areas. This may allow the container to collapse into a small and compact size without the container cracking. The container can thus move from an unfolded configuration, in which the panels are extended to form a container to a smaller, folded configuration, in which the panels are arranged in a space saving configuration such that the space required to store the container may be reduced.

Optionally, the plurality of panels may be pivotally connected by a plurality of couplings extending between the panels, the one or more flexible seals, or both. This allows the strength of the coupling to be varied at different positions within the container.

Optionally, a first one of the plurality of couplings may be arranged to extend a different length between the panels compared to a second one of the plurality of couplings such that in the folded configuration the plurality of panels are stacked in a desired configuration. This allows the panels to stack efficiently in a desired space saving arrangement when in the folded configuration.

Optionally, one or more of the plurality of couplings may be arranged to extend along a part circular path between at least a first and a second of the plurality of panels. This may allow the stress forces within the couplings to be evenly distributed.

Optionally, the collapsible container may further comprise a guide means arranged to guide the plurality of panels into the desired configuration. This allows the plurality of panels to be guided into a desired compact and space saving arrangement, Optionally, the plurality of panels and the plurality of couplings may form an integral framework. This may allow the framework to be efficiently manufactured from a single moulding.

Optionally, at least one of the plurality of couplings may comprise a region of the integral framework having a reduced thickness. This may allow the coupling to be efficiently manufactured from the same material as the panels.

Optionally, one or more of the plurality of couplings may be arranged to bias the plurality of panels towards the unfolded configuration. This allows the container to spring back to the unfolded configuration.

Optionally, the one or more seals may comprise a deformable membrane extending between at least a first and a second of the plurality of panels. The deformable membrane may therefore deform when the plurality of panels move from the unfolded configuration to the folded configuration. This allows the plurality of panels to adopt a small and compact arrangement when in the folded configuration and reduces the effect of stress points within the container which may otherwise lead to cracking.

Optionally, the deformable membrane may further comprise a covering portion arranged to extend over a surface of at least one of the plurality of couplings. This may allow the pivotal coupling to be provided by both the deformable membrane and the coupling and may allow the deformable membrane to protect the coupling.

Optionally, the deformable membrane, or a combination of the at least one of the couplings and the covering portion of the deformable membrane, may be approximately equal in thickness to an adjacent one of the plurality of panels. This forms a smooth joint between the flexible membrane and the panels. This may allow the container to be more easily cleaned.

Optionally, the one or more seals may be further arranged to bias the plurality of panels towards the unfolded configuration. This allows the container to 'spring back' to the unfolded position.

Optionally, the container may comprise a plurality of seals forming an integral web. This allows the seals to be efficiently manufactured from a single moulding.

Optionally, the framework is arranged to be contained within a body of a lid of the container when the plurality of panels are in the folded configuration. This allows the container to adopt a small and compact arrangement and so be more efficiently stored.

Optionally, the collapsible container may further comprise a securing means arranged to secure the plurality of panels in the folded configuration. This allows the container to be secured in the folded configuration for storage.

Optionally, the securing means may comprise a coupling between a first and a second of the plurality of panels. This allows the securing means to be engaged by movement of the panels to the folded configuration.

Optionally, the securing means may comprise a coupling between the framework and a lid of the container. This allows the lid to hold the framework in the folded position and at the same time means that the lid does not become separated from the container.

In a second aspect, the present invention provides a method of making a collapsible container, comprising the steps of: moulding a framework comprising a plurality of pivotally connected panels; and moulding one or more flexible seals interposed between the plurality of panels to form a seal therebetween, wherein the plurality panels are movable between an unfolded configuration for use of the container and a folded configuration for storage of the container.

Optionally, the moulding may be by injection moulding. This may allow efficient manufacture of the container.

Figure 2A:
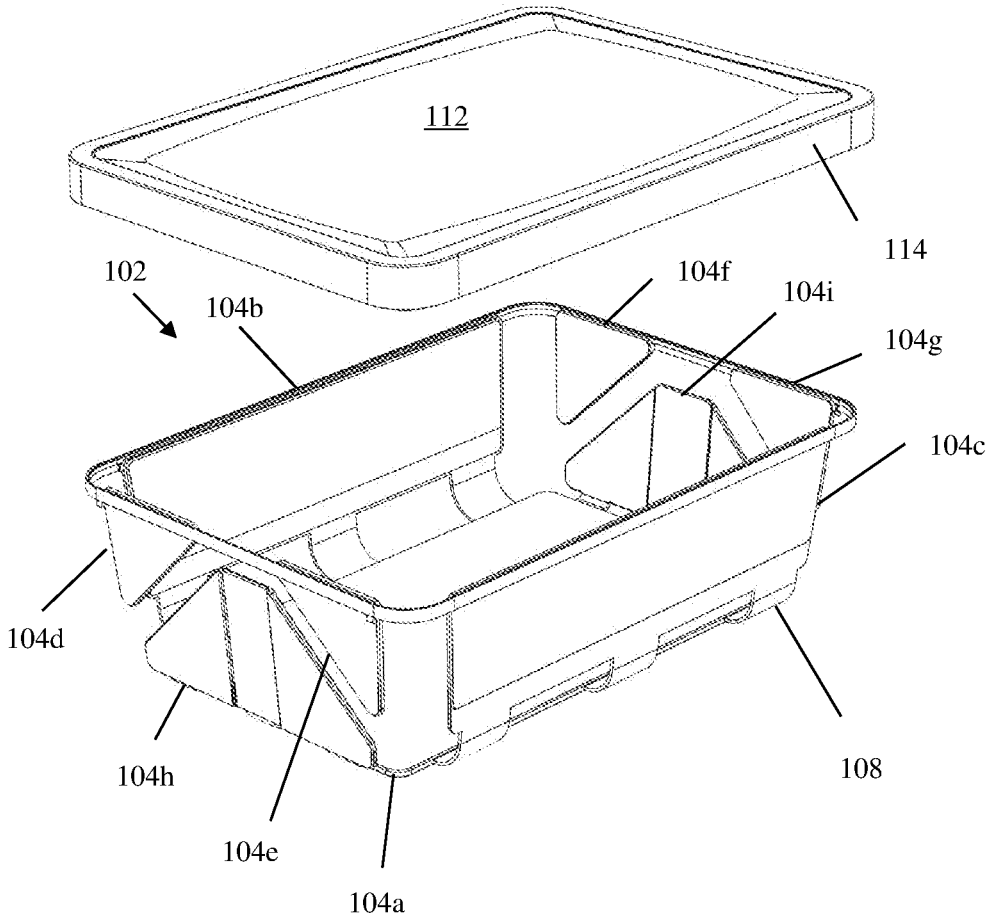
Figure 2B:
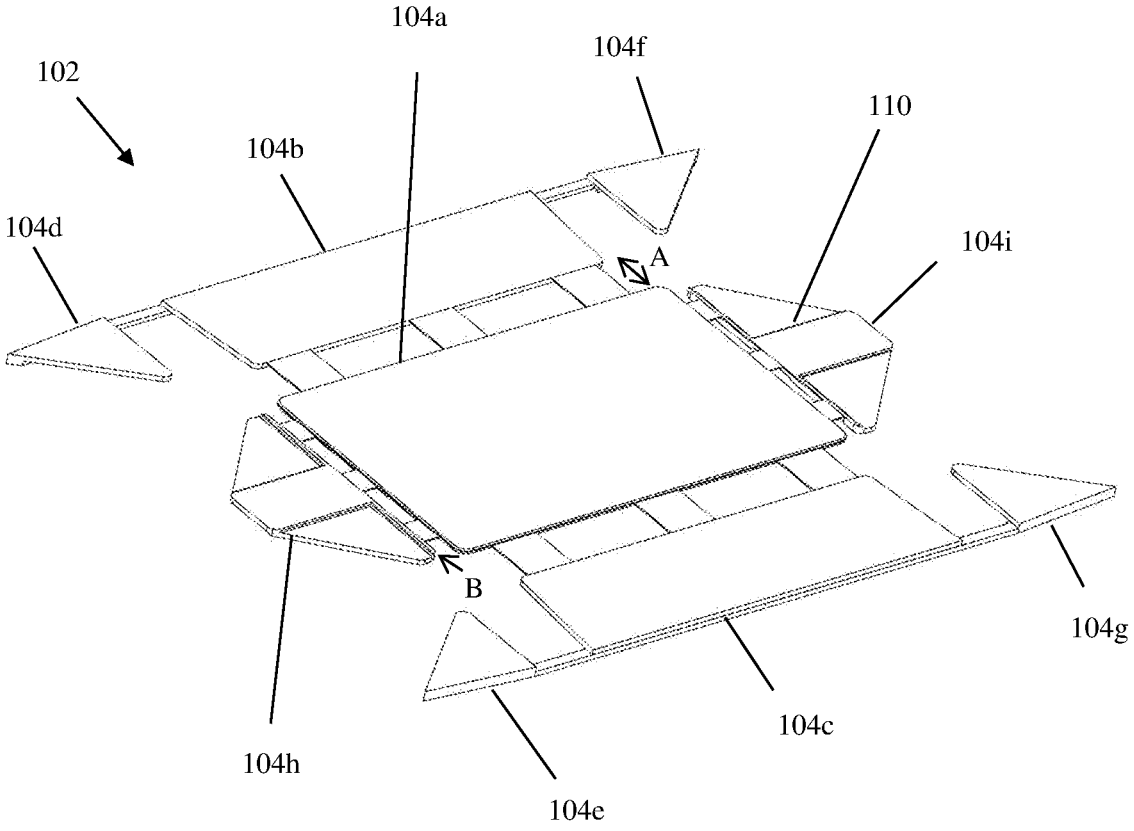
Figure 3:
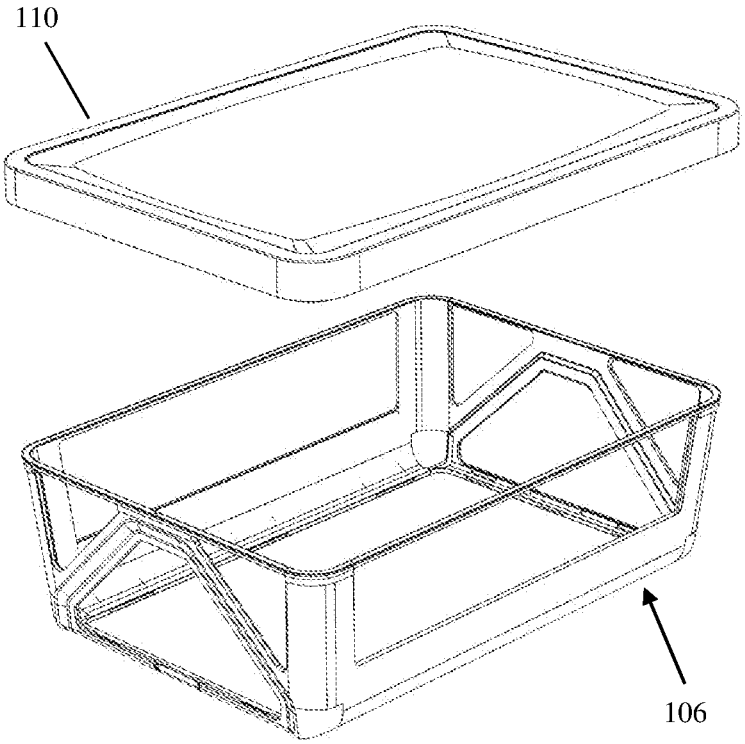
Figure 4A:
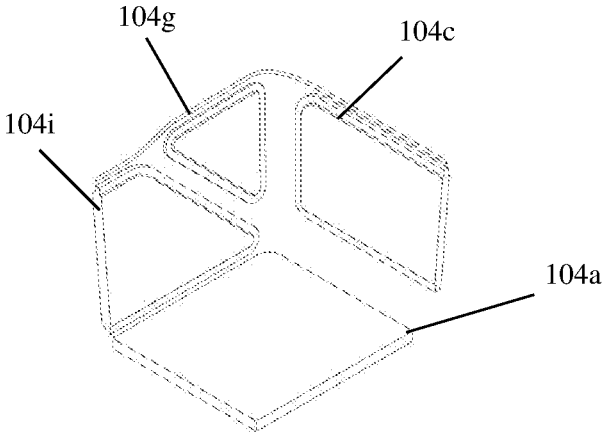
Figure 4B:
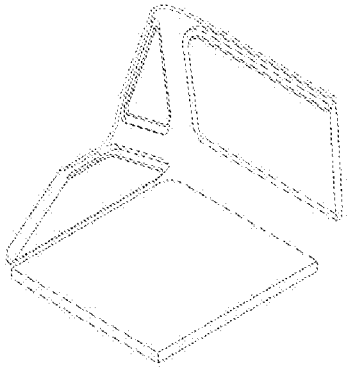
Figure 4C:
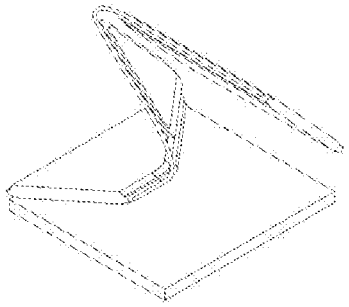
Figure 4D:
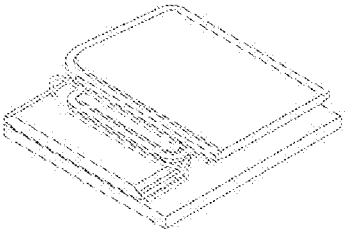
Figure 5A:
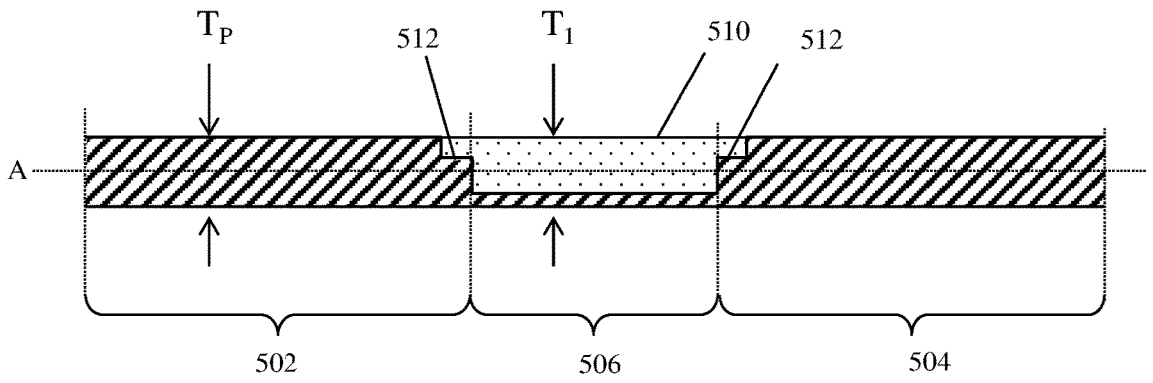
Figure 5B:
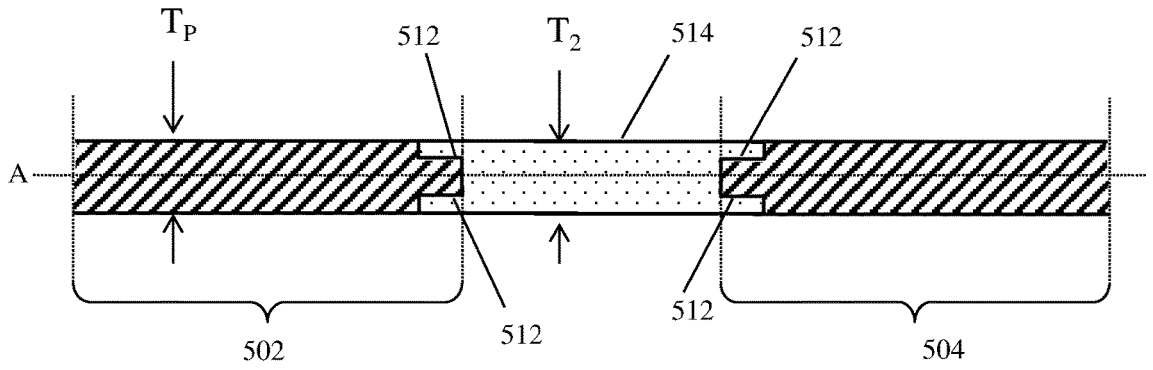
Figure 5C:
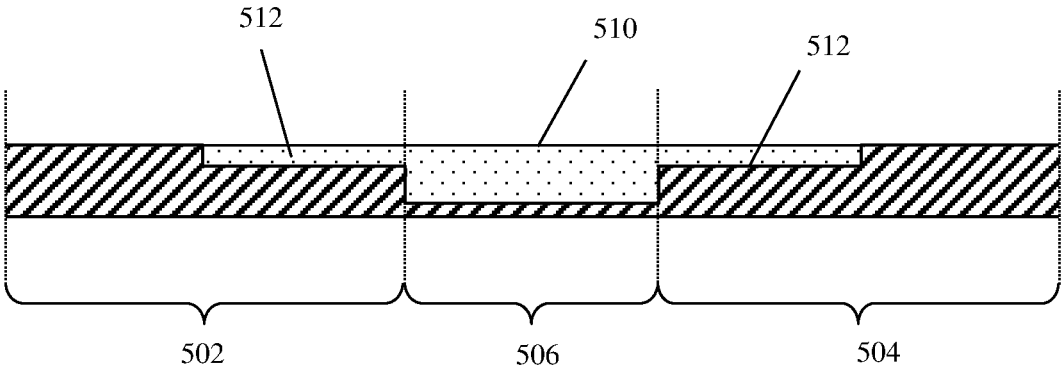
Figure 5D:
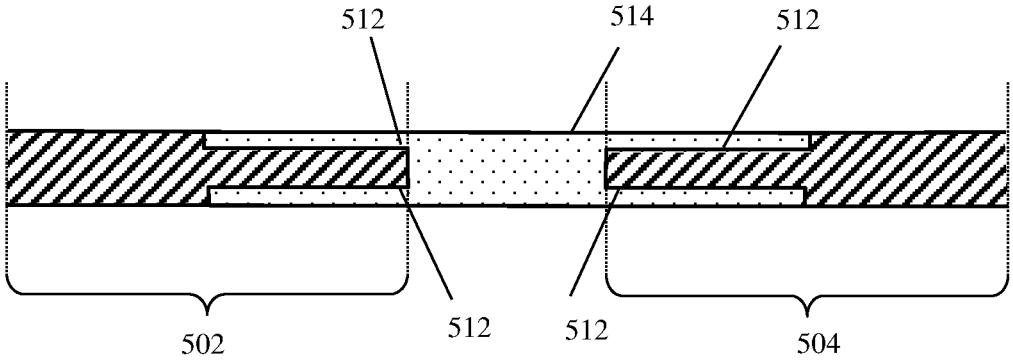
Figure 5E:
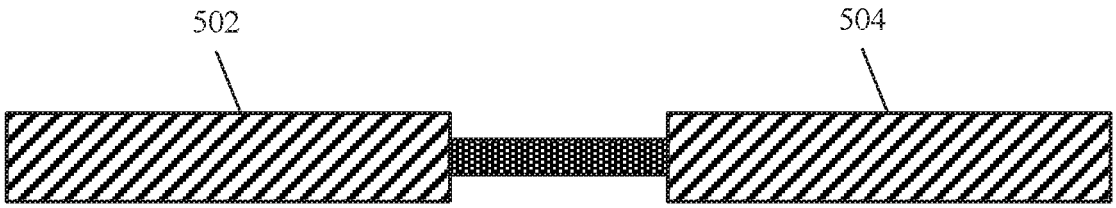
Figure 5F:
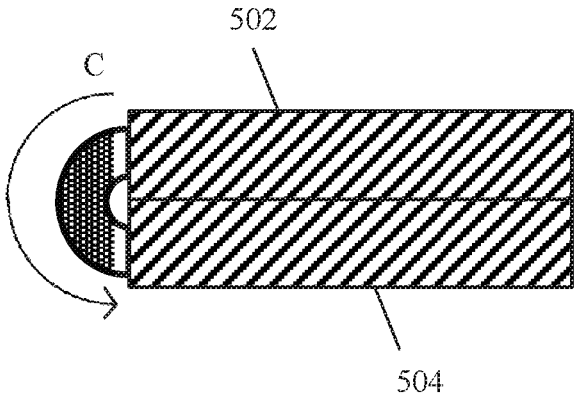
Figure 6:
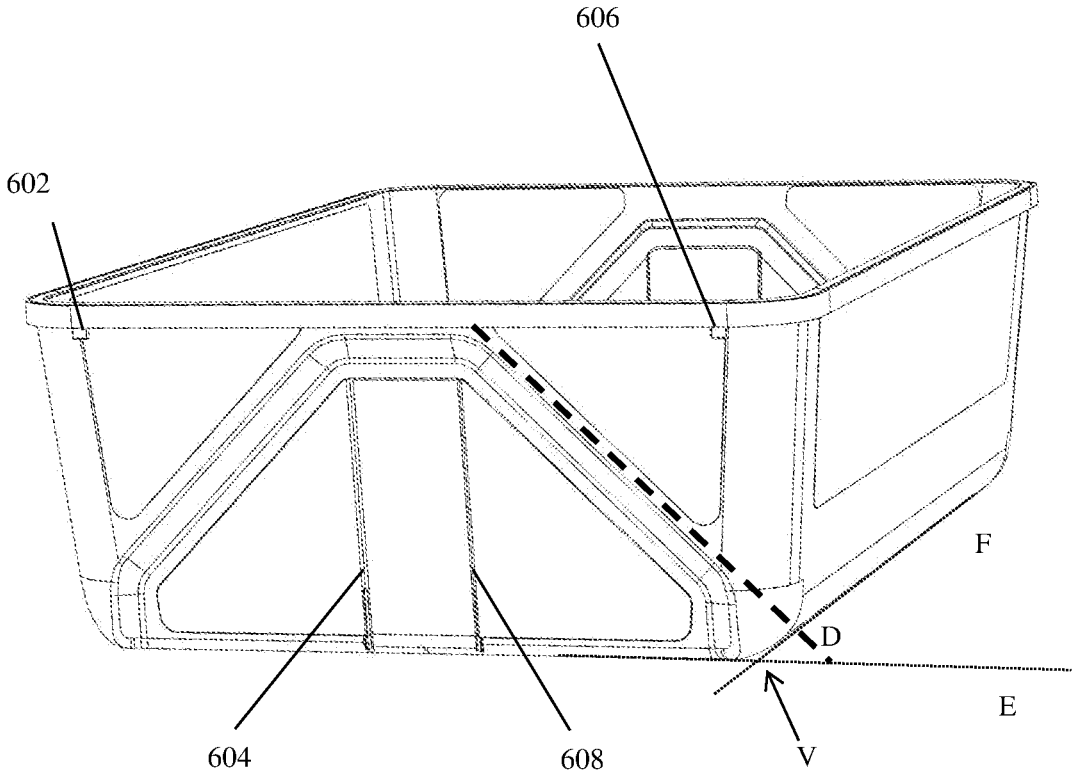

Embodiments of the invention will now be described, by way of example only, with reference to the accompanying drawings, in which:

FIG. 1 shows a collapsible container according to an embodiment of the invention;

FIG. 2*a* shows a framework and a lid of the collapsible container of FIG. 1;

FIG. 2*b* shows a framework of an embodiment of the collapsible container;

FIG. 3 shows a seal and the lid of the collapsible container of FIG. 1;

FIGS. 4*a* to 4*c* show a portion of a framework of the collapsible container according to an embodiment of the invention moving between an unfolded configuration and a folded configuration;

FIGS. 5*a*, 5*b*, 5*c*, 5*d*, 5*e* and 5*f* show cross section views of a link between panels of the container shown in FIG. 1; and FIG. 6 shows a securing means according to an embodiment of the invention.

A collapsible container 100 according to an embodiment of the invention is shown in FIG. 1. The collapsible container 100 comprises a framework 102 (shown separately in FIG. 2*a*) comprising a plurality of pivotally connected panels 104*a-i*. The plurality of panels 104*a-i* are movable between an unfolded configuration and a folded configuration (as shown schematically for a portion of the framework 102 in FIGS. 4*a* to 4*d*). In the unfolded configuration, the plurality of panels 104*a-i* form a receptacle suitable for use as a container. In some embodiments, the container may be a food container suitable for storing food or the like. In other embodiments, the container may have a size and shape suitable for storing any object or item and may for example be a medicine container, or a container used for transporting goods (e.g. may be a packing crate or the like). In the folded configuration, the plurality of panels 104*a-i* are in a collapsed configuration suitable for storage of the container 100. In the folded configuration, the framework 102 is reduced in size when compared to the unfolded configuration, thus reducing the amount of space taken up by the container 100 when it is being stored between uses.

The container 100 further comprises one or more flexible seals 106 interposed between the plurality of panels 104*a-i*. The one or more seals 106 provide a seal between the panels 104*a-i* in order to seal the container 100 such that it may be suitable for storing food or the like. In some embodiments, an air tight seal may be provided which may help to aid preservation of items being stored (e.g. where the container is a food container). In other embodiments, the degree of sealing may vary in a range between being substantially air tight to being a close fit sufficient to prevent leakage from the container 100 or to prevent small items being stored from falling out of the container 100. This range may include, for example, a water tight seal. The framework and the seals may be composed of different materials to each other e.g. the panels may be formed from a rigid material whereas the seals may be formed from deformable material which is suitable to allow movement of the panels.

By providing a container 100 comprised of a combined framework 102 of panels 104*a-i* interspersed with flexible seals 106 the container 100 can be made to collapse to a small and compact size while reducing the effects of stress points within the container material which may otherwise cause the container material to crack or fail or otherwise compromise the structural integrity of the container. For example, if the container were produced from a single continuous rigid material rather than the framework and seal combination of the present invention, the material may crack or fail along points at which it is folded (e.g. at the corners of the container or along other fold lines). Alternatively, if a container were produced from a single continuous flexible material, rather than the framework and seal combination of the present invention, the material would not provide adequate structural integrity to maintain the shape of the container. The present invention solves this problem by removing material at stress points within the walls of the container. The gaps left by the removal of such material are sealed by the one or more seals so that a sealed container is provided. By providing a container comprised of a framework of rigid panels combined with flexible seals, the material properties can be varied according to their position within the container This may allow flexing and deformation of the container material in some areas (e.g. in the corners of the container 100), but rigidity in others. This may allow the container to collapse into a small and compact size without the container cracking. The positioning of the one or more seals may be intelligently chosen so as to achieve these advantages. For example, the one or more seals may be located at a junction between three of more of the plurality of panels (e.g. at a point where three or more of the panels meet, which may, for example, be in the corners of the container). At the junction of three or more of the panels, the stress forces created when the container is moved to the folded configuration may be particularly significant. By replacing material at such a position with a flexible seal material the chance of cracking or failure of the container wall may be reduced.

Each of the plurality of panels 104*a-i* may be formed from a rigid material so as to provide structural integrity to the container 100. This is in contrast to the one or more seals, which may be formed from a different, more flexible material. In alternative embodiments, some of the panels (e.g. panels 104*d* to 104*h*) may be made of a more flexible material than the other panels, and may for example be made of the same materials as the seals. The panels 104*d* to 104*h* in such embodiments may be thicker than the seals so as to give them increased rigidity as compared to the seals.

The panels 104*a-i* may be formed from a plastics material such as polypropylene or polyethylene, but in other embodiments may be formed from any other suitable materials such as wood, composite material (e.g. carbon fibre) or metal etc. As can be seen in FIGS. 2*a* and 2*b*, the plurality of panels 104*a-i* may differ in shape and size throughout the framework 102. In the described embodiment, the plurality of panels 104*a-i* comprises a base panel 104*a* having a generally rectangular or square shape. The base panel 104*a* forms the base of the container. The container 100 may further comprise side walls. In the described embodiment, the first, second third and fourth side walls are provided, and the side walls comprise a first pair of opposing walls each comprised of a generally rectangular (e.g. square) wall panel 104*b*, 104*c*, along with a second pair of opposing walls, each comprised of a central panel and two further panels. The two further panels are first and second triangular wall panels 104*d*, 104*e*, 104*f*, 104*g*. The central panel is a trapezoid wall panel 104*h*, 104*i*. As each wall of the second pair of opposing walls comprises multiple panels which are pivotally connected, these walls can fold and may therefore be described as foldable walls.

The embodiment shown in FIGS. 2*a* and 2*b* is however only one such example of an arrangement of panels 104*a-i* suitable to form the framework 102. In other embodiments, the plurality of panels 104*a-i* may comprise any other suitable number of panels having any number of suitable sizes and shapes as would be apparent to the skilled person. For example, the panels may be shaped to form containers of different overall shapes such as a cylindrical container.

In the embodiment shown, the surface of each further panel 104*d-g* is around one third of the size of the central panel 104*h,i*. The further panels 104*d-g* are small enough that they can both fit within the footprint of the central panel in the folded configuration without overlapping each other. In alternative embodiments, assuming symmetrical further panels, each further panel can be up to one half of the size of the central panel. In some embodiments, the further panels 104*d-g* may be around one quarter of the size of the central panel 104*h,i*. In such cases, the further panels may have the same size and shape as the triangular edge portions of a trapezoidal central panel 104*h*,I such that the further panels align with the triangular edge portions in the folded configuration.

As shown in FIG. 2*a*, in the described embodiment the plurality of panels 104*a-i* are pivotally connected by flexible hinge members. The hinge members are described as flexible because the material(s) of the hinge members is/are arranged to bend in use between a first conformation in the unfolded configuration and a second conformation in the folded configuration of the container.

In the embodiment being described, the flexible hinge members comprise a plurality of couplings (only one of which is labelled as 108 in the figures) extending between the panels 104*a-i*. The couplings 108 may comprise a flexible connecting material extending between each of the plurality of panels 104*a-i* to allow the panels to pivot with respect to one another (e.g. the coupling may form a strap hinge extending between the panels). In the described embodiment, the couplings 108 and the panels 104*a-i* may be formed from the same material so as to form an integral framework. This allows the framework to be efficiently manufactured and may provide an improved bond between the couplings 108 and the panels 104*a*-I compared to bonding together individual components. In such an embodiment, each of the couplings may comprise a region of the integral framework having a reduced thickness compared to the thickness of the material forming the panels 104*a-i*. This allows the plurality of panels 104*a-i* and the plurality of couplings 108 to be formed from the same material, while also allowing the panels 104*a-i* to be suitably rigid and the couplings 108 to be flexible in order to provide the pivotal connection. The material forming the coupling may be reduced in thickness (e.g. without altering the alignment of molecules in the material forming the hinge) to an amount sufficient to allow bending or flexing of the coupling. In some embodiments, the thickness may be tailored according to the material properties of the coupling and according to the location of the coupling within the framework to allow sufficient bending of the coupling. For example, the thickness chosen may depending on the type of material and the degree of bend required. By forming the couplings from an area of reduced thickness, the framework may be efficiently manufactured from a single material and using a single moulding process.

In some embodiments, any one or more of the couplings may be formed from a living hinge in which molecules forming the hinge material are aligned so as to increase the flexibility of the material. In yet other embodiments, the couplings may be formed from a lattice hinge. In yet other embodiments, any suitable form of hinge may be used as would be apparent to the skilled person. In some embodiments, some or all of the couplings 108 may be formed from a different material to the panels 104*a-i*. In the described embodiment, all of the plurality of couplings 108 are shown to take the same form. In other embodiments however, the plurality of couplings 108 may not be all of the same form and may take different forms (e.g. may be made from different materials) depending on their position within the framework 102.

In the described embodiment, the plurality of panels 104*a-i* are also pivotally coupled by the one or more seals arranged to extend between the panels. In some embodiments, the couplings 108 may be absent and the pivotal connection between each of the plurality of panels 104*a-i* may be provided only by the seals. In other embodiments, the connections between panels may be provided by a mixture of only the couplings 108, only the one or more seals, or both one of the couplings and one of the seals. For example, in the embodiment of the framework shown in the figures, the couplings 108 are only provided at links between the base panel 104*a* and the wall panels 104*b*, 104*c*, 104*h*, 104*i* which are pivotally connected directly to the base panel 104*a*. The pivotal connection between the remaining panels is provided only by the one or more seals 106. This may allow the framework to be moulded as a flat sheet (or net) as shown in FIG. 2*b* which may allow the framework to be moulded more efficiently. In other embodiments, couplings may be provided to link any number of the plurality of panels and may be provided along some or all of the edges of each panel. In some embodiments, the couplings may, for example, be provided between all of the adjacent panel edges.

In some embodiments, the length of the link (e.g. the flexible hinge member which provides the pivotal connection) between a first pair of the plurality of panels (e.g. the length of the coupling or seal linking them) may be a greater than the length of the link (e.g. flexible hinge member which provides the pivotal connection) between a second pair of the plurality of panels so as to allow the panels to stack in the desired configuration when the container is in the folded configuration. In some embodiments, the longer link between the first pair of panels may be formed from both one or more of the couplings 108 and the one or more seals, whereas the shorter link between second pair of panels may be formed from the seal material only. This allows the material forming the link between the panels to be intelligently chosen according to the position within the folding container. Where a short link is required to allow the panels to stack when in the folded configuration greater stress will be created and so a more flexible material is required. This may allow the folded configuration to be more compact without leading to stress in the pivotal connections that would lead the container to fail. This also may make the container easier to manufacture because very thin couplings 108 are not required to allow enough flexibility for the container to collapse.

In some embodiments, the flexible hinge members may each have different lengths, such that opposing pairs of side walls have unmatching flexible hinge members.

In some embodiments, where a panel is pivotally connect by only the one or more seals, that panel may also be made from the same material as the one or more seals. In such an embodiment, the panel may be integrally formed with the one or more seals, which may allow the container to be more easily manufactured.

In some embodiments, one or more of the opposing walls of the container may be formed entirely from the same material as the one or more seals (e.g. the panels of those walls of the container may be formed from the same material as the one or more seals), whereas the base and other opposing walls may be made from a rigid material. In one particular embodiment, the generally rectangular or square panels 104*b*, 104*c* forming the first pair of opposing walls may be made from a rigid material. The first pair of opposing walls may be linked via both couplings 108 and the one or more seals to the base 104*a*. The triangular and/or trapezoid panels 104*d*, 104*e*, 104*f*, 104*g*, 104*h*, 104*i* forming the second pair of opposing walls may be formed from the same deformable elastomer material as the one or more seals. In this embodiment, these panels are also linked only by the one or more seals. The panels and seals forming the second pair of opposing side walls may be integrally formed from a single piece of the elastomer seal material. As the material linking the triangular and trapezoid panels is under greater stress when the container is moved to the folded configuration, these parts of the container may advantageously be made from the elastomer seal material. This allows the container to fold easily without failing, and may also make the container easy to manufacture by reducing the need to make very thin couplings 108 between panels.

In the described embodiment, each of the couplings 108 is arranged to extend part way along a respective one of the edges of each of the plurality of panels 104*a-i*. This allows gaps to be formed within the framework 102 to allow it to move more easily from the unfolded configuration to the folded configuration. If the couplings were to extend along all of the length of each of the panels 104*a-i*, stress points may occur when the panels are moved to the folded configuration. In the described embodiment, the number of couplings 108 linking the adjacent edges of each of the plurality of panels varies throughout the framework 102. For example, a link between adjacent edges of two of the plurality of panels 104*a-i* may be provided by a single coupling 108 (e.g. between panels 104*d* and 104*h* in the figures), whereas other links between edges of adjacent panels may be provided by two, three, four or more couplings (e.g. the link between panels 104*a* and 104*h* may be provided by three couplings).

In some embodiments, the couplings 108 may be arranged to bias the plurality of panels 104*a-i* towards the unfolded configuration. This allows the container 100 to spring back automatically to the unfolded configuration when released from the folded configuration. Embodiments where the couplings are formed from reduced thickness portions of material as described above may, for example, act to bias the plurality of panels to the unfolded configuration without the need of additional biasing means.

An example of a portion of the framework 102 moving from the unfolded configuration to the folded configuration is shown schematically in the sequence of FIGS. 4*a* to 4*d*. In these figures, neither the couplings between panels, nor the one or more seals 108, are shown. In the described embodiment, the length of the couplings 108 may vary throughout the framework 102. For example, a first one of the plurality of couplings 108 may be arranged to extend a different length between a first and a second of the plurality of panels 104*a-i* compared to a second one of the plurality of couplings 108 linking the first panel with a third of the plurality of panels 104*a-i*. Some of the couplings 108 are therefore longer than others (i.e. the length of the couplings may vary throughout the container). This allows the plurality of panels 104*a-i* to stack in a desired configuration when in the folded configuration. By stacking the panels in this way, the framework may have a small and compact size when the panels are in the folded configuration. In the described embodiment, one of the couplings 108 arranged to link a first of the panels (e.g. the base panel 104*a*) with a second one of the panels (e.g. one of the rectangular wall panels 104*i*, 104*h*) may extend a greater length between those panels compared to the length extended by one of the couplings 108 arranged to link the first panel and a third of the panels (e.g. one of the trapezoid wall panels 104*d*, 104*e*, 104*f*, 104*g*). In other embodiments, any other of the couplings 108 may have a length suitable for the panels 104*a-i* to adopt any desired stacking configuration when in the folded configuration, with the figures showing only one such example of a desired staking configuration. In embodiments where some or all of the pivotal connections are provided by the one or more seals extending between the panels (rather than the plurality couplings), the length extended by the seal between each of the panels may be varied. This will also allow the panels to adopt the desired stacking configuration.

The length and position of couplings may be chosen such that when the plurality of panels are in the unfolded or folded configuration, one of more of the couplings 108 may be arranged to extend along a part circular path (e.g. may be part of the circumference of a circle, such as a semi-circular or quarter circular path) between respective panels. One or more of the couplings may, for example, be bent into a semi-circular or quarter-circular shape such that it follows part of the circumference of a circle. This may allow a smooth or uniform bend of the coupling material. This may allow the stress within the couplings to be distributed more evenly and reduce the risk of the material cracking or failing. In some embodiments, the path followed by each of the couplings may be tailored to the specific location with the framework and may depend on the stress experienced by each of the couplings.

The length of each flexible hinge member is the distance it extends between the two panels it connects. As the flexible hinge members are curved in use, the inside length is longer than the outside length. The outside length, marked C in FIG. 5*f*, is referred to as the length in the following.

As is shown most clearly in FIG. 2*b*, the spacing between the base 104*a* and the two longer side walls 104*b*, 104*c*, labelled A in FIG. 2*b*, is longer than the spacing between the base 104*a* and the two shorter side walls 104*b*, 104*c*, labelled B in FIG. 2*b*. In the embodiment being described, the flexible hinge members 108 between the base 104*a* and the two longer side walls 104*b*, 104*c* are therefore longer than the flexible hinge members 108 between the base 104*a* and the two shorter side walls 104*b*, 104*c*. In alternative or additional embodiments, the flexible hinge members 108 may all have the same length in the unfolded configuration, but the flexible hinge members 108 between the base 104*a* and the two longer side walls 104*b*, 104*c* may be made of a stretchable material such that they are longer than the other flexible hinge members 108 in the folded configuration. Preferably, in such embodiments, the material of the flexible hinge members 108 between the base 104*a* and the two longer side walls 104*b*, 104*c* is more stretchable than the material of the other flexible hinge members.

The flexible hinge members 106, 108 are arranged to have part-circular cross-sections in use. In the folded configuration, the cross-sections are semi-circular as shown in FIG. 5*f*.

In the folded configuration, the base panel 104*a* and the trapezoid wall panels 104*h*, 104*i* are arranged to be adjacent to each other. Ideally, each trapezoid wall panel 104*h*, 104*i* abuts the base panel 104*a*. In some cases, the trapezoid wall panels 104*h*, 104*i* may not quite lie flat on the base panel 104*a*. The length C of the flexible hinge member 108 between the base panel 104*a* and each trapezoid wall panel 104*h*, 104*i* is at least π times the panel thickness ($T_P$) to allow the panels to stack in this way, i.e. so that the flexible hinge member can provide a semi-circular section of the circumference of a circle with a diameter equal to the thickness of two panels. Close stacking reduces the space taken by the container in the folded configuration. In the embodiment being described, the hinge length C is greater than $\pi T_P$ to allow some leeway in the folded configuration. In this way, the panels can still be stacked substantially flat even when, for example, the inside of the container has not been cleaned after use and remnants of container contents prevent the panels from moving into contact.

In some embodiments, the flexible hinge member 108 has a length of between $\pi T_P$ and $(5/2)\pi T_P$, and optionally between $(3/2)\pi T_P$ and $(5/2)\pi T_P$. The skilled person will appreciate that a balance is sought between making the container 100 compact in the folded configuration (for which reduced hinge sizes may be preferable) and lowering stress in the pivotal connections (for which wider hinge sizes may be preferable).

In the folded configuration, the trapezoid wall panels 104*h*, 104*i* are arranged to be between the base panel 108*a* and the panels 104*b*, 104*c* of the other side walls.

In the embodiment shown, the foldable side walls are shorter than the other pair of side walls—in alternative embodiments, all four side walls may be of the same length, or the foldable side walls may be longer than the other pair of side walls. The length C of the flexible hinge member 108 between the base panel 104*a* and each wall panel 104*b*, 104*c* of the other side walls is at least 2π times the panel thickness ($T_P$) to allow the panels to stack in this way. The increased length of the flexible hinge member allows more panels to be accommodated between the hinged panels.

In the embodiment being described, the hinge length C is greater than $2\pi T_P$ to allow some leeway in the folded configuration, and may be, for example between $2\pi T_P$ and, and $5\pi T_P$, optionally between $3\pi T_P$ and $5\pi T_P$. In this way, the panels can still be stacked substantially flat even when, for example, the inside of the container 100 has not been cleaned after use and remnants of container contents prevent the panels from moving into contact.

The longer flexible hinge member is arranged between the base 104*a* and a side wall (in the embodiment shown, the single panel side walls 104*b*, 104*c*), and is arranged to be on the outside of the plurality of panels in the folded configuration. In the folded configuration, the base 104*a* and the side wall which are pivotally connected via the longer flexible hinge member have one or more other panels sandwiched between them. The longer hinge length is long enough to 'wrap around' the one or more panels between the panels hinged by that longer hinge member, and also around the shorter hinge between the sandwiched panels.

In some embodiments, the longer hinge may not be twice the length of the shorter hinge, and/or the flexible hinge members around the base 104*a* may each have a different length. In some cases, panel width, $T_P$, may not be equal for all panels; minimum hinge member length may therefore vary around the edges of a given container 100.

For neatness and compactness in the folded configuration of the container 100, the length of the longer flexible hinge member is sufficient to allow the side wall to which it is connected to be substantially parallel to the base in the folded configuration such that the side wall, the base and the longer flexible hinge member form a U-shape in cross-section. The adjacent side wall and the shorter flexible hinge member between that adjacent side wall and the base are accommodated within the U-shape, insofar as they overlap (i.e. the adjacent side wall is longer than the height of the first side wall, so extends out from underneath the first side wall in the folded configuration).

In this way, the container 100 retains a cuboid shape in the folded configuration as the panels are stacked horizontally. The hinge members provide enough flexibility to allow the panels to lie substantially flat with respect to each other in the folded configuration.

The skilled person would recognise that each pivotal connection can only continue until it intersects with another one or more pivotal connections. Using an elastomeric material around the intersections facilitates accommodation of stresses around the intersections between the pivotal connections without failure. The degree to which the container's corners are provided by the intersection of flexible hinge members is chosen to allow the pivotal connections to work independently from one another i.e. so that their movement is not impeded by another pivotal connection.

The skilled person will appreciate that, in other embodiments, the foldable side walls may have the longer flexible hinge members and that the other side walls may have the shorter flexible hinge members and lie between the foldable side walls and the base in the folded configuration.

At the lower corner regions of the container, the longer and shorter flexible hinge members 106, 108 meet. The corner regions are curved such that bending stresses are distributed over an area instead of being focused to a point. Advantageously, the rounded corner regions may improve longevity of the container 100 as the flexible hinge members are less likely to fail or develop holes at stress points through repeated use. The term "vertex" is used herein to denote the precise point, V, at which the base and sides would meet were the corner of the container not rounded; i.e. where straight lines along the surface of each panel (e.g. dotted lines E and F in FIG. 6) would meet. Were the corners not rounded, stress would be concentrated at the vertices, V, due to multiple pivotal connections with different axes passing through the same point.

In the embodiment being described the two further panels 104*d*, 104*e*, 104*f*, 104*g* are offset from the lower edge of the container; i.e. there is a vertical gap between the lower extreme of each further panel and the base 104*a* of the container. In this way, a bend line between each further panel and the trapezoidal panel 104*h*, 104*i* (which may be thought of as an axis of the pivotal connection between the panels—e.g. that marked by the dashed line D in FIG. 6) is offset from the vertex of the container. Advantageously, this offset further distributes stresses in the flexible hinges.

Each bend line D between a central panel and a further panel is at 45° to the base 104*a* and the side walls. Advantageously, this facilitates symmetrical folding of the container 100. In alternative embodiments, more further panels, and therefore multiple bend lines D, and may be provided. In such embodiments, the angle of each bend line with respect to the base 104*a* may not be 45°.

In the embodiment being described, the lower extreme of each further panel is offset from the base 104*a* of the container by around one third of the height of the container 100. In this embodiment, the bend line D passes through the rounded corner region of the container 100, but not through the vertex, V. In alternative embodiments, the offset may be between one tenth and nine tenths of the height of the container, and more preferably between one fifth and three fifths of the height of the container.

Further, the trapezoid shape of the central panels 104*h*, 104*i* means that the bend lines, D, between each further panel and the trapezoidal panel 104*h*, 104*i* do not intersect each other, as they are separated by the width of the trapezoid panel. In alternative embodiments in which the central panel is triangular, the bend lines D may intersect. The point of intersection of bend lines D may have increased stress and therefore be more prone to failure.

In some embodiments, a guide means may be provided to guide the plurality of panels 104*a-i* into the desired stacking configuration. In some embodiments, the guide means may comprise a recessed portion 110 in one or more of the panels 104*a-i* arranged to at least partly receive another of the panels 104*a-i* when they are in the folded configuration. The recess portion 110 may therefore guide the panels into the desired configuration and may further reduce the size of the framework when in the stacked configuration by allowing the panels to at least partly interlock. In other embodiments, the guide means may comprise one or more locating members arranged on one or more of the panels 104*a-i*. Each of the locating members may be arranged to engage with a respective indent on another of the panels 104*a-i* to guide them into the desired stacking configuration.

In the described embodiment, the one or more seals 108 are formed from a deformable membrane extending between each of the plurality of panels 104*a-i*. The one or more seals may comprise a material (e.g. an elastomeric material) arranged to deform under stress and still return to its previous size and shape without permanent deformation (i.e. the one or more seals may undergo elastic deformation). The deformable membrane may be bonded to a respective one of the panels by any one or more of: chemical bonding, adhesive bonding, welding (e.g. melt-welding) or mechanical bonding. The bonding method may vary between different panels of the framework 102 or may be the same for each panel. The deformable membrane may be formed from a material such as any artificial or natural elastomer. The deformable membrane may be formed from any suitable material which is able to deform to a sufficient level to allow the plurality of panels to move to the folded configuration, without experiencing permanent deformation. This allows a seal to be maintained between the panels 104*a-i*, while at the same time allowing movement of the panels 104*a-i* between the folded configuration and the unfolded configuration. In the described embodiment, the one or more seals comprise an integral web formed from a single material as can be seen in FIG. 3 (which shows the deformable membrane separately from the framework 102). This allows a seal to be provided between all of the panels by a single moulding of material so that the container 100 may be efficiently manufactured. In other embodiments, a plurality of individual seals may be provided to extend separately between each of the panels 104*a-i* of the framework 102. In other embodiments, a combination of an integral web extending over a first part of the container 100 (e.g. between some of the plurality of panels 104*a-i*) and one or more further individual seals extending over a second part of the container (e.g. between the remaining panels not connected by the integral web) may be provided. In yet other embodiments, the deformable membrane may be arranged to extend over some or all of the plurality of panels 104*a-i*. For example, the deformable membrane may cover part or all of one or both sides of the framework 102 (e.g. such that the framework is embedded within the integral web).

In some embodiments, the one or more seals may be arranged to bias the plurality of panels 104*a-i* towards the unfolded configuration. This allows the container to spring back to the unfolded configuration when it is released from the folded configuration. In some embodiments, the one or more seals may be formed from an elastomeric material such that they are arranged to return to a shape corresponding to the unfolded configuration after being deformed by movement to the folded configuration. This means that the one or more seals 106 may act to both bias the panels and to seal the container without the need for additional components. In other embodiments, a separate biasing means may be provided to return the plurality of panels 104*a-i* to the unfolded configuration. Such a biasing means may, for example, comprise a spring member or the like to bias the plurality of panels 104*a-i* towards the unfolded configuration. In some embodiments, the plurality of panels 104*a-i* may be biased towards the unfolded configuration by the one or more seals 106, one or more of the couplings 108, or both.

FIGS. 5*a* and 5*b* show examples of a cross section through a joint between a first 502 and a second 504 of the plurality of panels. In FIG. 5*a*, the first panel 502 is shown coupled to a second panel 504 by one of the plurality of couplings 506. In the embodiment shown, the coupling 506 is formed from a section of reduced thickness extending between the panels 502, 504 as described earlier. In this embodiment, the deformable membrane further comprises a covering portion 510 arranged to extend over a surface of the coupling 506. This allows the pivotal connection between the panels 502, 504 to be provided by both the deformable membrane and the coupling 506. In some embodiments, a covering portion may be provided over both faces of the coupling 506. The covering portion may act to protect the coupling and provide additional strength to the container. As can be seen in FIGS. 5*a* and 5*b*, the deformable membrane (510, 514) may be furthest from the centre line A of the panels and so may experience a greater level and stress when the panels pivot relative to each other. It is therefore advantageous to provide the deformable (e.g. elastomeric) membrane at such locations so as to prevent failure and cracking of the container.

In the embodiment shown in FIG. 5*a*, the first and second of the panels 502, 504 comprise a lip portion 512 formed from a lip or recess running along at least part of a respective edge of each of the panels 502, 504. The covering portion of the deformable membrane is further arranged to extend over each of the lip portions 512 in order to provide an improved seal between the deformable membrane and the panels. This may allow a mechanical bonding between the panels and the deformable membrane, which may be used in addition or alternatively to other bonding techniques.

FIG. 5*b* shows a cross section through a joint between the first and second of the plurality of panels 502, 504 at a point where they are linked only by a portion of the deformable membrane 514. In this case, a lip portion 512 may also be provided along a respective portion of the edge of one or both of the panels 502, 504 to improve the seal between the panels and the deformable membrane. In other embodiments, the deformable membrane may extend over some or all of the surface of the panels in addition to extending over the lip portion.

In some embodiments, a lip portion 512 may be provided on both sides of the panels 502, 504 as shown in FIG. 5*b*, or in other embodiments, only one side of each or both of the panels may include a lip portion. In yet other embodiments, the lip portion(s) may not be present.

As shown in FIGS. 5*a* and 5*b*, a combination of the coupling 506 and the covering portion of the deformable membrane 510 may have a thickness, $T_1$, approximately equal to the thickness, $T_P$, of an adjacent one of the panels. Where the panels 502 and 504 are linked only by the deformable membrane the deformable membrane 514 may have a thickness, $T_2$, approximately equal to the thickness, $T_P$, of an adjacent one of the panels. This means that the effective wall thickness is substantially the same throughout the container. This means that a smooth joint may be provided between the deformable membrane and the panels which may allow the container to be easily cleaned.

In other embodiments, the thickness of the material linking the edges of a first and second of the panels may be less that the thickness of those panels (as shown in FIGS. 5*e* and 5*f*). In some embodiments, a combination of the coupling 506 and the covering portion of the deformable membrane 510 linking at least two of the panels may have a thickness less than the thickness of one of those panels (i.e. $T_1$ is less than $T_P$). Where the panels 502 and 504 are linked only by the deformable membrane, the deformable membrane 514 may have a thickness less than the thickness of an adjacent one of the panels (i.e. $T_2$ is less than $T_P$). The material linking at least two of the panels may be recessed on one or both sides to reduce the thickness so that it is less than the adjacent panels. This may reduce stress within the link between the panels when the container is moved to the folded configuration. As shown in FIG. 5*f*, when in the folded configuration, the faces of at least two of the panels are arranged to abut one another, which limits the extent of the pivotal motion between the panels. By reducing the thickness of the material linking the panels the stress within the material is reduced.

The lip portion 512 may vary in width from the edge of the panel between different portions of a panel edge, between different edges of a panel, or between edges of different panels within the framework (i.e. it may vary throughout the framework). As shown in FIGS. 5*c* and 5*d*, each of the lip portions 512 may be extended a greater distance from the respective edge of each of the panels 502, 504 in comparison to the lip portions 512 shown in FIGS. 5*a* and 5*b*. For links between particular panels (or along particular portions of an edge of a panel) where a large deformation of the membrane is produced when the panels are moved from the unfolded configuration to the folded configuration, a wider lip portion may be provided in order to maintain sufficient sealing.

The container 100 may further comprise a lid 112 as shown in FIG. 2*a*. The framework 102 may comprise a coupling means arranged to couple the lid 112 and the framework 102 so as to seal the lid 112 to the walls of the container 100. The coupling means may comprise a friction fit coupling or the like extending along and between edges of the panels where the framework is arranged to couple to the lid 112. In some embodiments, the framework 102 may be arranged to be contained within a body of the lid 112 when the plurality of panels 104*a-i* are in the folded configuration. This provides a small and compact arrangement of the lid 112 and framework 102 so that the container 100 can be efficiently stored when not in use.

In some embodiments, the container 100 may further comprise a securing means arranged to secure the plurality of panels 104*a-i* in the folded configuration. This allows the plurality of panels 104*a-i* to be secured in the folded configuration such that the container is compact and can be efficiently stored. In some embodiments, the securing means may comprise a coupling between a first and a second of the plurality of panels 104*a-i*. In such an embodiment, an additional coupling means may be provided to secure the lid 112 to the framework such that they do not become separated from one another.

In other embodiments, the securing means may alternatively or additionally comprise a coupling between the framework 102 (e.g. between one or more of the plurality of panels 104*a-i*) and the lid 112 of the container 100. In such an embodiment, the lid 112 is therefore arranged to both secure to the framework to prevent it from being lost, and also at the same time to secure the plurality of panels 104*a-i* in the folded configuration. For example, the lid 112 may comprise an outer rim 114 extending from the surface of the lid around the outer edge of the lid, and an inner rim (not shown) concentric with the outer rim and spaced from the outer rim. The spacing between the rims is arranged to engagingly receive the side walls of the container 100 so as to seal the container in its unfolded configuration.

The inner rim is arranged to engagingly receive the plurality of panels in the folded configuration, such that they are held in the folded configuration and attached to the lid 112.

Due to the shape of the flexible hinge members 106, 108, the total width of the base 104 plus flexible hinge members 106, 108 around the edges of the base decreases when the container 100 is folded. This is because the hinge members have a curved shape, and preferably an approximately quarter-circular shape in the unfolded configuration as compared to a semi-circular shape in the folded configuration. In the embodiment being described, the hinge member length, C, is substantially constant in use. When the same length, C, is used for a smaller circular section, the radius of that circle is necessarily larger, and vice versa. The radius of curvature of the hinge members is therefore larger in the unfolded configuration, meaning that the hinge members extend further from the base 104*a*, so making the container footprint larger. In the folded configuration, each hinge member is forced inwards, so reducing the footprint of the plurality of panels sufficiently for the plurality of panels to be received within the inner rim of the lid 112.

In some embodiments, one or both of the outer rim 14 and the inner rim may be replaced with a series of projections.

In each of these embodiments, the securing means may comprise a friction fit coupling (i.e. a snap-fit coupling) arranged to engaged when the plurality of panels 104*a-i* are moved to the folded configuration. An example securing means is shown in FIG. 6. In this embodiment, the securing means comprises a first projection 602 disposed on a first of the plurality of panels of the container and a groove or indentation 604 disposed on a second of the plurality of panels. In this embodiment, the securing means further comprises a second projection 606 arranged to engage with a second indentation 608. In other embodiments, only one projection and indentation may be provided, and in yet other embodiments, more than two projections and indentations may be provided on other panels of the container. The projections and indentation are located on the panels such that they are brought into engagement when the panels are moved to the folded configuration to secure the panels in place. The securing means may therefore allow the plurality of panels to be automatically secured by the same movement as moving the panels to the folded configuration. In other embodiments, the securing means may comprise any other suitable two-part coupling such as a hook and loop coupling as would be apparent to the skilled person. In other embodiments, the securing means may comprise a latch or the like which may be manually engaged by the user once the plurality of panels 104*a-i* have been moved to the folded configuration.

The present invention may also provide a method of manufacturing the container 100 described above. The method may comprise a step of moulding the framework 102 by moulding the plurality of panels 104*a-i* and the couplings 108 (if and where they are present) to connect the panels 104*a-i*. A separate step of moulding the one or more flexible seals 106 interposed between the plurality of panels 104*a-i* is then also provided.

The moulding steps may be achieved by injection moulding of the framework 102 and the one or more seals 106. In some embodiments, the framework may be moulded using a first injection moulding process followed by a second injection moulding process to mould the one or more seals 106 (e.g. the one or more seals may be over-moulded). In some embodiments, separate moulds may be used to mould the framework and the one or more seals. In other embodiments, a single mould may be used (e.g. a twin-shot injection moulding process may be used) which may allow an improved bond to be created between the panels and the deformable membrane.

Various aspects of the invention may be understood with reference to the following clauses:

1. A collapsible container, comprising:
   a framework comprising a plurality of pivotally connected panels; and
   one or more flexible seals interposed between the plurality of panels to form a seal therebetween, wherein the plurality of panels are movable between an unfolded configuration for use of the container and a folded configuration for storage of the container.
2. A collapsible container according to clause 1, wherein the plurality of panels are pivotally connected by: a plurality of couplings extending between the panels; the one or more flexible seals; or a combination of both the plurality of couplings and the one or more flexible seals.
3. A collapsible container according to clause 2, wherein a first one of the plurality of couplings is arranged to extend a different length between the panels compared to a second one of the plurality of couplings such that in the folded configuration the plurality of panels are stacked in a desired configuration.
4. A collapsible container according to clause 2 or clause 3, wherein one or more of the plurality of couplings may be arranged to extend along a part circular path between a first and a second of the plurality of panels.
5. A collapsible container according to clause 4 or clause 5, further comprising a guide means arranged to guide the plurality of panels into the desired configuration.
6. A collapsible container according to any preceding clause, wherein the plurality of panels and the plurality of couplings form an integral framework.
7. A collapsible container according to clause 6, wherein at least one of the plurality of couplings comprises a region of the integral framework having a reduced thickness.
8. A collapsible container according to any of clauses 2 to 7, wherein one or more of the plurality of couplings are arranged to bias the plurality of panels towards the unfolded configuration.
9. A collapsible container according to any preceding clause, wherein the one or more seals comprises a deformable membrane extending between at least a first and a second of the plurality of panels.
10. A collapsible container according to clause 9, wherein the deformable membrane further comprises a covering portion arranged to extend over a surface of at least one of the plurality of couplings.
11. A collapsible container according to clause 9 or clause 10, wherein the deformable membrane, or a combination of the at least one of the couplings and the covering portion of the deformable membrane is approximately equal in thickness to an adjacent one of the plurality of panels.
12. A collapsible container according to any preceding clause, wherein the at least one seal is further arranged to bias the plurality of panels towards the unfolded configuration.
13. A collapsible container according to any preceding clause, wherein container comprises a plurality of seals forming an integral web.
14. A collapsible container according to any preceding clause, wherein the framework is arranged to be contained within a body of a lid of the container when the plurality of panels are in the folded configuration.
15. A collapsible container according to any preceding clause, further comprising securing means arranged to secure the plurality of panels in the folded configuration.
16. A collapsible container according to clause 15, wherein the securing means comprises a coupling between a first and a second of the plurality of panels.
17. A collapsible container according to clause 15 or clause 16, wherein the securing means comprises a coupling between the framework and a lid of the container.
18. A collapsible container substantially as described herein with reference to, or as shown in, any one or more of the accompanying drawings.
19. A method of making a collapsible container, comprising the steps of:
   moulding a framework comprising a plurality of pivotally connected panels; and
   moulding one or more flexible seals interposed between the plurality of panels to form a seal therebetween, wherein the plurality panels are movable between an unfolded configuration for use of the container and a folded configuration for storage of the container.
20. A method according to clause 19, wherein the moulding is by injection moulding.
21. A method substantially as herein described with reference to any one or more of the accompanying drawings.

The invention claimed is:

1. A collapsible container having an unfolded configuration for use of the container and a folded configuration for storage of the container, the container comprising a plurality of panels arranged to form:
   a base;
   a first side wall pivotally connected to a first edge of the base by a first flexible hinge member;
   a second side wall pivotally connected to a second edge of the base by a second flexible hinge member, the second edge of the base being adjacent to the first edge of the base;
   wherein the base and at least one of the first and second sidewalls are made from a rigid first material;
   wherein the first and second flexible hinge members are each formed at least partly from a flexible second material extending between the first side wall and the first edge of the base and the second side wall and the second edge of the base respectively, the first and second flexible hinge members being arranged to bend in use such that they have a semi-circular cross-sectional shape in the folded configuration, wherein the first and second flexible hinge members meet at a corner region of the container, wherein the corner region is rounded such that the first and second flexible hinge members are curved where they meet when the container is in the unfolded configuration, and wherein, in the folded configuration, the first side wall lies between the base and the second side wall and the second flexible hinge member is longer than the first flexible hinge member so as to accommodate the first side wall between the base and the second side wall.

2. The collapsible container according to claim 1, wherein the base is rectangular.

3. The collapsible container according to claim 2, further comprising third and fourth side walls pivotally connected to edges of the base, such that the container comprises:

a first pair of opposing side walls;

a pair of first flexible hinge members, each located on one edge of the rectangular base and arranged to pivotally connect a side wall of the first pair of opposing side walls to that edge;

a second pair of opposing side walls arranged to be at least substantially perpendicular to the first pair of opposing side walls in the unfolded configuration; and a pair of second flexible hinge members, each located on one edge of the rectangular base and arranged to pivotally connect a side wall of the second pair of opposing side walls to that edge;

wherein, in the folded configuration, the first pair of opposing side walls lie between the base and the second pair of opposing side walls, and wherein further each first flexible hinge member is longer than each second flexible hinge member so as to accommodate the first pair of opposing side walls between the base and the second pair of opposing side walls.

4. The collapsible container according to claim 3, wherein the first pair of opposing side walls are foldable walls, wherein each foldable wall comprises three pivotally connected panels, the three panels comprising:

a central panel pivotally connected to an adjoining edge of the base, and which is substantially the same width as the adjoining edge of the base in the region of the adjoining edge and which decreases in width away from the adjoining edge; and two further panels, each further panel being pivotally connected between the central panel and an adjacent side wall of the container, and wherein optionally each of the two further panels of each foldable wall is spaced from the adjoining edge such that the axis of the pivotal connection between the central panel and each further panel does not pass through a vertex of the container.

5. The collapsible container according to claim 4 wherein the panels of the base and the second pair of opposing walls are formed from a rigid material and wherein the panels of the first pair of opposing walls are formed from the same material as the one or more first flexible hinge members, the material of the first flexible hinge members being more flexible than the rigid material of the base and the second pair of opposing walls.

6. The collapsible container according to claim 1, wherein any one or more of:

a) at least some of the flexible hinge members are shaped to mitigate stress; and b) the container is a sealable food container.

7. The collapsible container according to claim 1, wherein either the first side wall or the second side wall is a foldable wall, wherein the foldable wall comprises three pivotally connected panels, the three panels comprising:

a central panel pivotally connected to an adjoining edge of the base, and which is substantially the same width as the adjoining edge of the base in the region of the adjoining edge and which decreases in width away from the adjoining edge; and two further panels, each further panel being pivotally connected between the central panel and an adjacent side wall of the container, and wherein each of the two further panels of each foldable wall is spaced from the adjoining edge such that the axis of the pivotal connection between the central panel and each further panel does not pass through a vertex of the container.

8. The collapsible container according to claim 7, wherein at least one of either:

the central panel is trapezoid in shape such that the pivotal connections between the central panel and each further panel do not intersect each other, and each further panel is smaller than the central panel and arranged such that, in the folded configuration, each further panel lies adjacent to, and within the footprint of, both the central panel and the base.

9. The collapsible container according to claim 1, wherein the length of the second flexible hinge member is sufficient to allow the second side wall to be substantially parallel to the base in the folded configuration such that the second side wall, the base and the second flexible hinge member form a U-shape in cross-section, with the first side wall and the first flexible hinge member being accommodated within the U-shape.

10. The collapsible container according to claim 1, wherein at least one of the flexible hinge members comprises a combination of both:

i) one or more seals, the one or more seals being flexible seals interposed between the plurality of panels to form a seal therebetween; and ii) at least one coupling extending between the two panels, wherein the at least one coupling is formed from the same material as the plurality of panels and the one or more seals are formed from a different material from the plurality of panels and the coupling.

11. The collapsible container according to claim 10, wherein the one or more seals comprise a deformable membrane extending between at least two of the plurality of panels.

12. The collapsible container according to claim 11, wherein the deformable membrane is approximately equal in thickness to an adjacent one of the plurality of panels, and/or has a smaller thickness compared to an adjacent pair of the plurality of panels.

13. The collapsible container according to claim 10, wherein the one or more seals comprise a deformable membrane extending between at least two of the plurality of panels and wherein the deformable membrane further comprises a covering portion arranged to extend over a surface of the at least one of the couplings.

14. The collapsible container according to claim 13, wherein the combination of the at least one coupling and the covering portion of the deformable membrane is approximately equal in thickness to an adjacent one of the plurality of panels and/or has a smaller thickness compared to an adjacent pair of the plurality of panels.

15. The collapsible container according to claim 10, wherein the at least one seal is further arranged to bias the plurality of panels towards the unfolded configuration.

16. The collapsible container according to claim 10, wherein the flexible hinge member between a first panel and a second panel of the plurality of panels is formed by the at least one coupling and the one or more seals extends a first length, and wherein the flexible hinge member between the first panel and a third panel of the plurality of panels extends a second length, the first length being greater than the second length, and wherein the flexible hinge member between the first and third panels is formed only by the one or more seals.

17. The collapsible container according to claim 1, further comprising a guide means arranged to guide the plurality of panels into the desired configuration.

18. The collapsible container according to claim 1, wherein the plurality of panels and the flexible hinge members form an integral framework.

19. The collapsible container according to claim 1, wherein one or more of the flexible hinge members are arranged to bias the plurality of panels towards the unfolded configuration.

20. The collapsible container according to claim 1, wherein at least one of either the container comprises a plurality of seals forming an integral web, and the plurality of panels is arranged to be contained within a lid of the container when the plurality of panels are in the folded configuration.

21. The collapsible container according to claim 1, further comprising securing means arranged to secure the plurality of panels in the folded configuration.

22. A collapsible container having an unfolded configuration for use of the container and a folded configuration for storage of the container, the container comprising a plurality of panels arranged to form:

a base;

a first side wall pivotally connected to a first edge of the base by a first flexible hinge member;

a second side wall pivotally connected to a second edge of the base by a second flexible hinge member, the second edge of the base being adjacent to the first edge of the base, wherein:

the base and at least one of the first and second sidewalls are made from a rigid first material;

the first and second flexible hinge members are each formed at least partly from a flexible second material extending between the first side wall and the first edge of the base and the second side wall and the second edge of the base respectively, the first and second flexible hinge members meet at a corner region of the container, in the folded configuration, the first side wall lies between the base and the second side wall and the second flexible hinge member is longer than the first flexible hinge member so as to accommodate the first side wall between the base and the second side wall, either the first side wall or the second side wall is a foldable wall, the foldable wall comprises three pivotally connected panels, the three panels comprising:

a central panel pivotally connected to an adjoining edge of the base, and which is substantially the same width as the adjoining edge of the base in the region of the adjoining edge and which decreases in width away from the adjoining edge; and two further panels, each further panel being pivotally connected between the central panel and an adjacent side wall of the container, and wherein each of the two further panels of each foldable wall is spaced from the adjoining edge such that the axis of the pivotal connection between the central panel and each further panel does not pass through a vertex of the container.

* * * * *